US005748058A

United States Patent [19]

Scott

[11] Patent Number: 5,748,058

[45] Date of Patent: May 5, 1998

[54] CROSS COUPLED BANDPASS FILTER

[75] Inventor: Richard D. Scott, Socorro, N. Mex.

[73] Assignee: Teledyne Industries, Inc., Los Angeles, Calif.

[21] Appl. No.: 383,264

[22] Filed: Feb. 3, 1995

[51] Int. Cl.[6] ..... H01P 1/205; H01P 7/06

[52] U.S. Cl. ..... 333/202; 333/203

[58] Field of Search ..... 333/202, 203, 333/206, 212, 134

[56] References Cited

U.S. PATENT DOCUMENTS

| | | | |
|---|---|---|---|
| 4,216,448 | 8/1980 | Kasuga et al. | 333/203 |
| 4,382,238 | 5/1983 | Makimoto et al. | 333/134 |
| 4,431,977 | 2/1984 | Sokola et al. | 333/306 |
| 4,730,173 | 3/1988 | Tsunoda | 333/206 |
| 4,740,765 | 4/1988 | Ishikawa et al. | 333/206 |
| 4,891,615 | 1/1990 | Komazaki et al. | 333/206 |
| 5,166,649 | 11/1992 | Aizawa et al. | 333/202 |
| 5,173,672 | 12/1992 | Heine | 333/206 |
| 5,250,916 | 10/1993 | Zakman | 333/206 |
| 5,291,158 | 3/1994 | Blair et al. | 333/126 |
| 5,329,687 | 7/1994 | Scott et al. | 29/527.2 |

FOREIGN PATENT DOCUMENTS

| | | |
|---|---|---|
| 0 524 011 | 1/1993 | European Pat. Off. . |
| 26 53 856 | 2/1978 | Germany . |
| 58-019001 | 4/1983 | Japan . |
| 58-178602 | 10/1983 | Japan . |
| 173903 | 7/1989 | Japan . |
| 204705 | 7/1994 | Japan . |
| 2 271 471 | 4/1994 | United Kingdom . |
| 93 24968 | 12/1993 | WIPO . |

OTHER PUBLICATIONS

Filtronic publication, Filtronic Components Limited, Sub Systems Division, West Yorkshire, England, 1994 (2 pp). no month.

K&L Microwave Incorporated, A Dover Technologies Company, Salisbury, England, 1988 (2 pp) no month.

*Primary Examiner*—Robert Pascal
*Assistant Examiner*—David Vu
*Attorney, Agent, or Firm*—Skjerven, Morrill, MacPherson, Franklin & Friel; Thomas S. MacDonald

[57] ABSTRACT

A filter housing has a series of linearly spaced resonators positioned in the housing. The resonators each include a conductive rod upstanding from a bottom wall of the housing. At least one coaxial cable portion has a first connecting section extending along a housing upper wall or housing cover, the cable portion having integral end sections including an inner conductor of the coaxial cable portion, extending variously into proximity to the conductive rods of a selected first two of the series of resonators, the first two of the resonators having at least one other resonator of the series of resonators extending therebetween. The periphery of the resonators may be configured variously with half or full circular or half or full elliptical peripheries. The filter may be diplexer or in higher degrees of multiplexing.

19 Claims, 7 Drawing Sheets

CROSS COUPLED BANDPASS FILTER

BACKGROUND OF THE INVENTION

1. Field of the Invention

This invention relates to bandpass filters and in particular to a combline cross coupled bandpass filter.

2. Description of Related Art

Filters are electronic circuits which allow electronic signals of certain frequencies, called a "passband" or "bandpass", to pass through the filter, while blocking or attenuating electronic signals of other frequencies. FIG. 1 illustrates a conventional bandpass filter 10 in a diplexer form, i.e. two filters, where the cross couplings 12, 14 and 16 are internal to the filter housing 15, namely extending between resonators 25 and 27, resonators 21 and 23 and resonators 33 and 36. The cross couplings 12, 14 and 16 each consist of brass rods 17 and 18 extending through a Teflon® bushing 19 having an outer surface flush with the top of the housing interior walls separating the resonator sections. Counterbores 37 are provided within the resonators. Tuning screws coming through a cover (not shown) may project into the counterbores without contacting the associated resonator. This realizes a coaxial capacitor. There are three capacitances associated with the resonator between the resonator and the cover (electrical ground), parallel plate, fringing, and coaxial. The parallel and fringing capacitance are fixed capacitances. The coaxial capacitance is adjustable. It is the adjustability of the coaxial capacitor that allows tuning of the filter.

A diplexer consists of two passbands. The passband that is centered at the lower frequency is referred to as the lowband. And alternatively, the other band is the highband. From the common input pin 9 (usually the antenna port) to pin 8 is the lowband of this diplexer. Cross coupling 16 introduces an attenuation pole to both the low and high side skirt of the lowband. Cross coupling 12 and 14 introduce two finite poles to the low skirt of the highband (one for each cross coupling). All the cross coupling shown are capacitive cross couplings. The result of adding cross couplings to the highside of the lowband and the lowside of the highband is an increased isolation between pins 8 and 9 (i.e. better isolation between the transmitter and receiver). Wall 6 separates the two filters. Iris walls 15*a* of varying depth may be provided to decouple the resonators (the narrower the filter bandwidth, the more the decoupling that is needed). The depth of the iris's, therefore, is used to set the filter bandwidth. These depths are determined empirically in the laboratory during filter development (if the filter is too narrow the iris is machined deeper). Conductors 7 and 8 function as signal inputs or outputs dependent on whether they are electrically connected to a receiver or transmitter.

U.S. Pat. No. 5,329,687 of the inventors herein illustrates a method of making high performance bandpass filters, albeit without cross coupling. U.S. Pat. No. 4,216,448 describes a coupled bandpass filter including resonator rods in rod cavities in a housing, with coupling windows (also called iris walls) therebetween, tuning screws extending through a housing cover for adjusting the electrical length of the rods, and projections on selected rods to capacitively couple selected rods.

Internal cross coupling is most easily accomplished when the filter topology is either folded (i.e. input next to output) or zigzagged. If the resonators are numbered sequentially from input to output, i.e. 20 to 28 or 20 to 31–36, then one can consider two different types of cross couplings. In what is referred to as a 1–3 coupling, one resonator 22 (or 26) is skipped in the cross coupling. Since ordinary combline filters are inductively coupled, if one cross couples 1–3 capacitively then it is possible to obtain a lowside attenuation pole. If the 1–3 cross coupling is inductive, then the attenuation pole achieved is a highside pole.

In 1–4 cross coupling, two resonators 34 and 35 are skipped as shown in the second filter in FIG. 1. If this cross coupling is capacitive, then attenuation poles are achieved on both the highside and lowside. If this cross coupling is inductive, there are no attenuation poles achieved. Instead, the group delay response of the filter is flattened (improved). This is important in some communication applications.

It is also possible to cross couple skipping three or more resonators. The results of these types of cross couplings are related to the 1–3 and 1–4 cross couplings above, depending on whether the number of skipped resonators is even or odd. It is also believed that to cross couple directly from the input to the output of a filter, while possible, may result in degraded rejection performance. "Rejection performance" as used above means that the signal extends outside the desired path (frequency range). This would seem feasible, since this type of cross coupling allows some of the signal to bypass the remainder of the filter. This has not yet been verified and in fact in a four section filter, this degradation is not apparent (although only two sections are being bypassed by the signal). In filters that are in line, the type of cross coupling discussed above is not possible.

The cross coupling 12 and 14 are capacitive 1–3 cross coupling which yields finite poles only on the lowside skirt. The effect on the high side skirt is to slightly degrade it. The use of 1–4 capacitive cross coupling 16 yields both a low and high side finite pole.

The ideal bandpass waveform would be one which would be akin to a square wave form, i.e., with vertical side edges extending from a horizontal band peak of the wave. For example, this would be the vertical lines extending above the coordinates $X_1$ and $X_2$ in FIG. 11. In common parlance in the field, this is referred to as a "brick wall". Recent actions by the U.S. Federal Communications Commission (FCC) allocates band widths which are so close to each other that there is a need to have high bandpass selectivity and a more confined band, the optimum being the above "brick wall". A selective filter is needed to separate transient bands from the desired band. For example, the FCC has designated one band D of 1885–1890 Mhz next to a band E of 1890–1895 Mhz.

Thus it is desired that a bandpass filter have as close as possible a square waveform shape with as few a number of resonator sections, e.g. resonators 20–28 (nine sections) or 20 and 31–36 (seven sections), as possible which will minimize the device footprint and envelope size and the manufacturing costs, while maximizing the performance characteristics. A difficulty of the internal cross coupling design of FIG. 1 is the need for a meandering configuration of resonators. This is typified by the narrow band filters of FIG. 1 and those of Filtronic Components, Ltd. (FCL) of Charleston, Shipley, West Yorkshire, U.K. A publication of K&L Microwave, Inc. of Salisbury, Md. shows that an increase in resonator sections results in better control of the bandwidth profile. Increasing the number of sections improves the filter skirt response but at the expense of insertion loss. Insertion loss degrades receiver sensitivity and reduces the power available to the antenna. The above related art necessitates relatively thick housing walls especially in 1–3 couplings, to accommodate the cross coupling between, say, 25–27, while still providing electrical isolation between 24–26. They also necessitate the use of special Teflon® blocks and the cutting of the brass rods to critical lengths to give a prescribed gap and the proper frequency for the finite pole.

As is known in the bandpass filter art and as seen in U.S. Pat. No. 4,431,977, the resonant frequency of the coaxial resonators is determined primarily by the depth of the resonator hole, the thickness of the resonator block, the plating thickness on the conductive rod and the use of tuning screws threadedly inserted through the cover toward and gapped from the tip of the resonator rod in the counterbores in the resonator. While the signals may be capacitively coupled to the resonator, it is preferred that the pins be mostly soldered to the resonator in what is known as direct tapping (direct as opposed to capacitive or inductive coupling).

SUMMARY OF THE INVENTION

The present invention provides a high performance, low cost bandpass filter which is cross coupled externally of the cavities.

The cross coupled bandpass combline in-line filter of the invention utilizes semi-rigid coaxial cable portions which are preferably cut and bent into an inverted U-shape. The shape of the cable is not as important as the electrical interconnection of the two resonators. In other words, it is possible to utilize a straight cable. The in-line filter may take the form of a straight linear series of sections or be in folded flat C-shape with the resonator sections being in-line albeit curved at one end. The ends of the outer coaxial conductor are cut off to expose an end of dielectric surrounding the central inner conductor of the coax cable. The dielectric may also be trimmed off exposing the center conductor. The bent cable section is inserted either through-apertures in a side wall(s) of the filter housing or embedded in the sidewalls or preferably in the cover of the filter housing so that the inner central conductor coaxial ends extend from an end of the dielectric into proximity, i.e. a spaced gap in the range of about 0.1 mm to about 2 mm with the conductive rods associated with a desired pair of resonators internal of the filter housing. It is also important that the outer conductor of the coaxial cable be well grounded, especially where it enters and leaves the apertures. Spacing from the tip end of the central coax conductor to the conductive rod of an associated resonator is dependent on the particular design. The smaller the gap the larger the capacitance and the closer the finite poles move in towards the passband edge. The cable(s) in the preferred embodiment extend exposed at the underside of the cover and are parallel to the plane of the cover. The exposed coax dielectric prevents an electrical short with the cover. The center conductor would still not short to the cover if the dielectric is removed (it would be separated by a distance equal to the outer conductor wall thickness and the thickness of the dielectric from the outside of the center to the inside of the outer conductor). The dielectric may be important for increasing the capacitance for designs where the finite pole is to be close to the bandedge. The end of the coaxial cable may also be bent down and across so as to decrease the gap to the resonator.

The cross coupled filter of the invention includes a filter housing having a series of linearly spaced resonators positioned in the housing, the resonators each comprising a conductive rod upstanding from a bottom wall of the housing and at least one coaxial cable portion having a first connecting section extending along a housing upper wall or the housing cover, the cable portion having integral end sections including an inner conductor of the coaxial cable portion, extending variously into proximity to a selected first two of the series of resonators, the first two of the resonators having at least one other resonator of the series of resonators extending therebetween.

DETAILED DESCRIPTION

Figure 1:
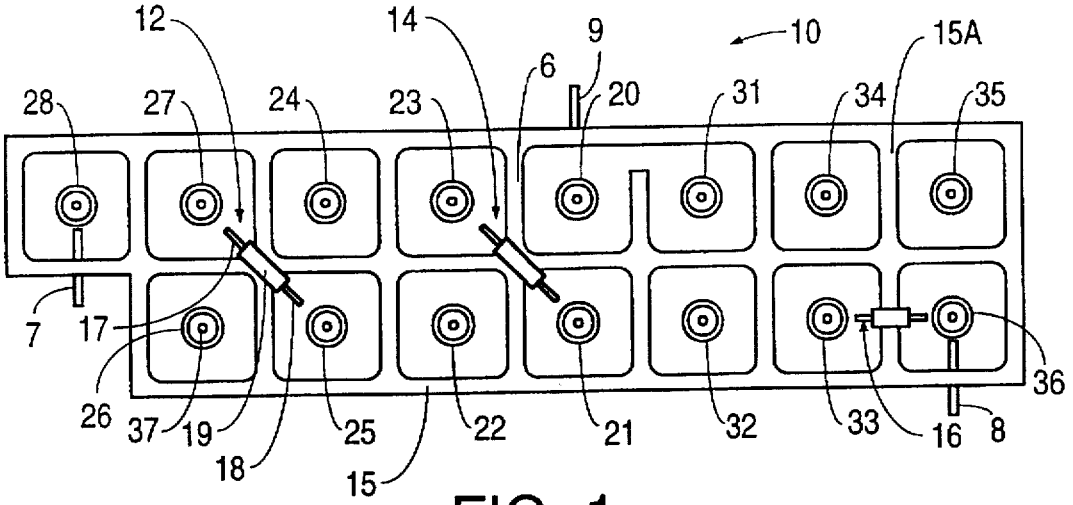
FIG. 1 (PRIOR ART)
FIG. 1 is a top view of an internal cross coupled bandpass filter of the prior art.
Figure 2:
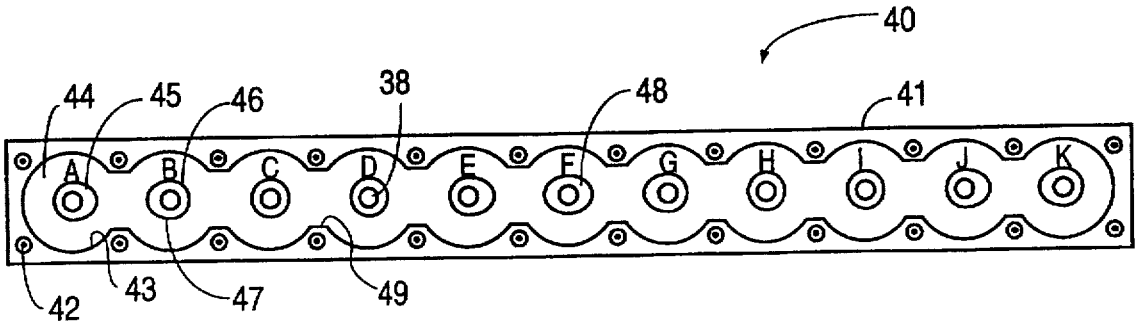
FIG. 2 is an in-line top view of the cross coupled bandpass filter of the invention prior to assembly of the cover and a cross coupling cable.

As seen in FIG. 2, the top view of the filter 40 less its cover shows an in-line filter housing 41 having a series of resonators A, B, C . . . , and K (A–K). Each resonator is centrally positioned in a cavity 43 and comprises a central conductive rod 45 in a bore 44 forming cavity 43. A coupling window or iris wall 49 extends between the cavities to narrow the cavity portions between the resonators. A cavity and a resonator together form a resonant cavity. A cavity is formed (with the resonator in place) by machining away the metal between the resonator (rod 45) and the cavity walls. A counterbore 38 in the top of resonator itself is useful in tuning in conjunction with a non-contacting tuning screw. Cavities may also be formed by counterboring and installing upstanding resonators (rods) into the housing using screws applied from the underside of the bottom of the housing into the resonators. The resonators may be configured with one-half being a circular segment and the other half being elliptical. The left half of resonator A and the right half 46 of resonator B are circular. The right half of resonator A and the left half 47 of resonator B are elliptical. The left half of resonator E and the right half of resonator G are circular. The right half of resonator E the left half of resonator G and resonator F are elliptical, the latter designated as ellipse 48. The left half of resonator J and the right half of resonator K are circular. The right half of resonator J and the left half of resonator K are elliptical. This increases the coupling between resonators while maintaining the distance between the centers of the rods.

Figure 3:
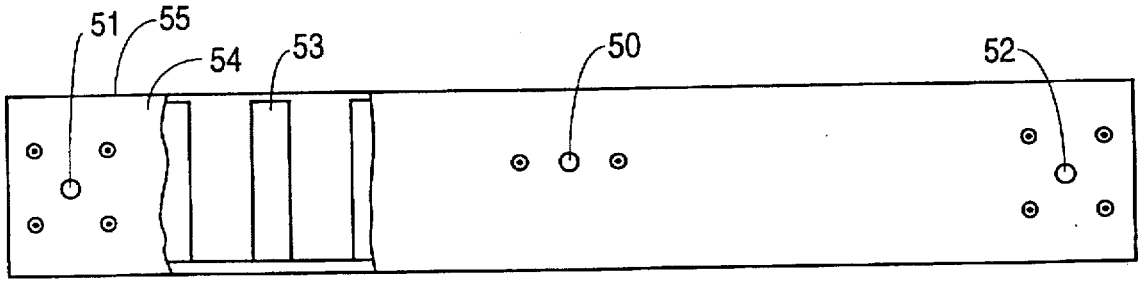
FIG. 3 is a partially broken-away side view thereof.
Figure 4:
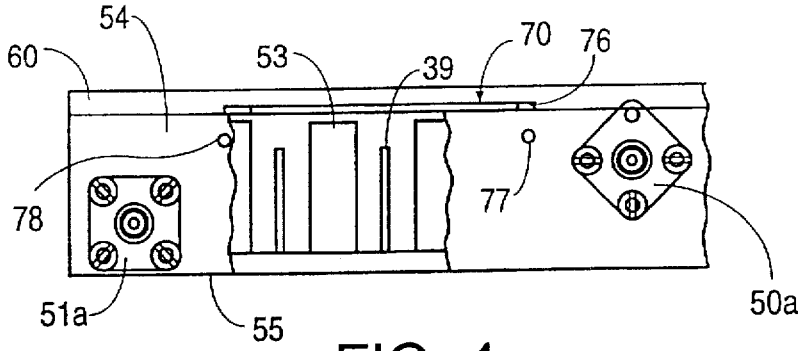
FIG. 4 is a partially broken-away side view thereof with input and output connectors attached and showing alternative cable mountings.

FIG. 3 illustrates one of the resonators 53 corresponding to the resonator "C". An iris wall 49 extends between each pair of resonators. Inlet/output ports 51 and 52 extend through a side wall 54 of filter housing 55. A third port 50 is provided for connection of a transmit-receive antenna (not shown). FIG. 4 illustrates the mounting of coax connector sockets 50*a* and 51*a* to wall 54 as well as the placement of cover 60 on the top of housing 55. FIG. 4 also illustrates the use of an iris wall 39 between the resonators used in another embodiment of the invention. The gap between the top of the resonators 53 and the bottom of the cover 60 is about 0.8 mm.

Figure 5:
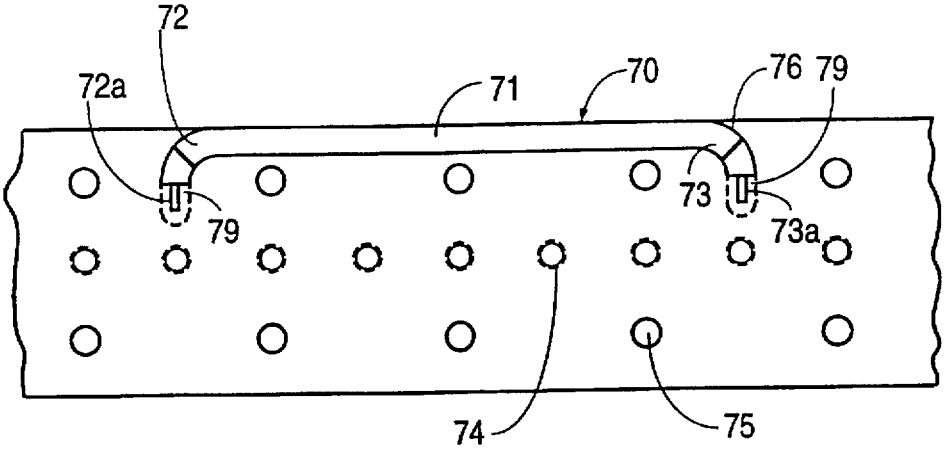
FIG. 5 is a detailed view of a coupling cable assembled on a cover underside edge.
Figure 6:
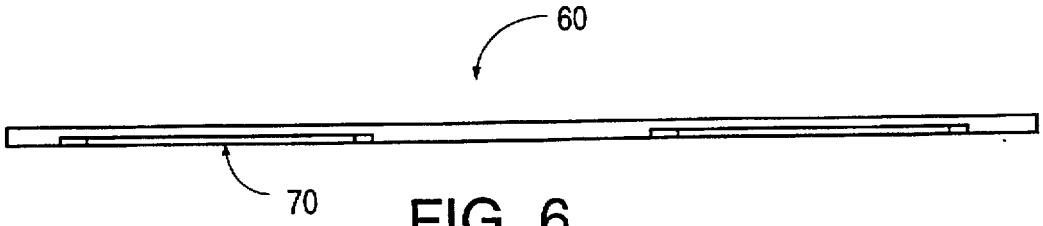
FIG. 6 is a side view of the housing cover prior to incorporating coupling cables.
Figure 7:
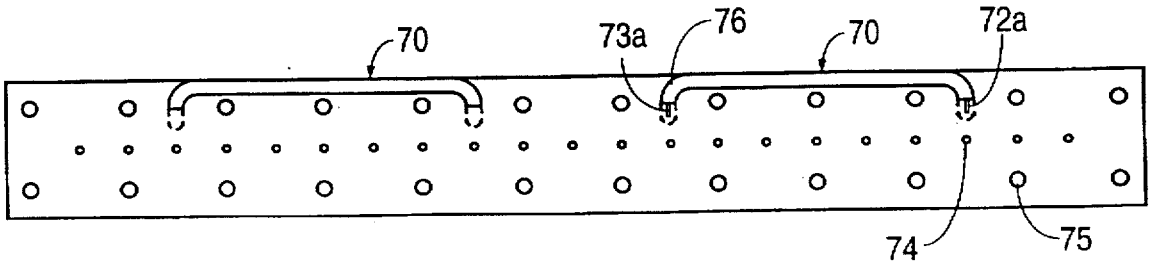
FIG. 7 is an underside view of the cover showing the operating position of the coupling cables.

The coax cable portion 70 is press-fitted into a slot 76 on a longitudinal edge of the cover but it can be attached with conductive epoxy, soldered, or otherwise mechanically attached. As seen in FIG. 5, the coaxial cable portion 70 is semi-flexible and has a straight connecting section 71 fittable into the cover slot 76 and bent at its ends 72 and 73, which ends, more particularly the conductive conductor tips 72*a* and 73*a* of the coax inner conductor, extend inwardly of the filter into proximity to the conductive rods of the resonator at a location next to the tuning screws (not shown). For clarity purposes, FIG. 6 shows the cover slot without a cable in place. The tuning screws extend through threaded aligned apertures 74 in the cover and to a spaced position over or into the counterbore 38 in each conductive rod. Apertures 75 are for receiving screws for mounting the cover 60 to the housing 55. To illustrate an alternative embodiment, the bent cable portion may be positionable on and in the housing 55 by including apertures 77 and 78 at the top of side wall 54 so that the bent cable portion particularly legs 72 and 73 can be inserted therethrough so that tips 72*a* and 73*a* of the inner coax conductor overlie a pair of resonators particularly adjacent to the resonators conductive rods. The ends of the cable do not have to be over the top of the resonator. They can be below the top and butt up to but not touch the resonator (rod). In the cover shown, they are over the top which may be an advantage to achieving a higher capacitance. In this embodiment, wall 54 will extend higher with respect to cover 60 and cover 60 will not have a slot 76 and a cable portion therein. In a typical configuration, the coax inner conductor tip ends 72*a* and 73*a* will protrude from an exposed coax dielectric portion 79 about 1.5 mm but this distance is not critical.

The housing and cover is preferably made of 6061 aluminum with a silver plating of 300 microinches (0.008 mm) minimum thickness per QQ-S-365 Type II with no nickel underplate. Silver plated plastic may also be employed as the material of construction. The coax cable portion has a typical length of 1.700 inches (4.4 cm.). In installing the cable connecting portion 71 in slot 76, the cable with its outer coax conductor may extend below the cover slightly. This provides good electrical grounding which is the necessity for good clamping. The dielectric of the cable portion is Teflon® plastic and is cut away about 1.5 mm from the inner coax conductor tip ends 72*a* and 73*a*. Designers of the cross coupled filter may use the commercially available Program Touchstone (Hewlett-Packard EeSof) as known in the art.

Particularly it has been found that the length of the cable coupling, e.g. the total length of the inverted U-shape extending from one resonator to another is quite critical. When a 1–3 cross coupling with a long cable of an electrical length of about ¾ wavelength, realizes a finite pole on the highside skirt of the filter response. Improvement in the highside skirt results in the degradation of the lowside skirt. When a shorter cable length is provided of approximately ½ wavelength, a lowside finite pole was realized. Contrarily, when the cable length in a 1–4 cross coupling was too electrically long, i.e. greater than ½ wavelength, it appeared that the length contributed to a poor filter response.

Figure 12:
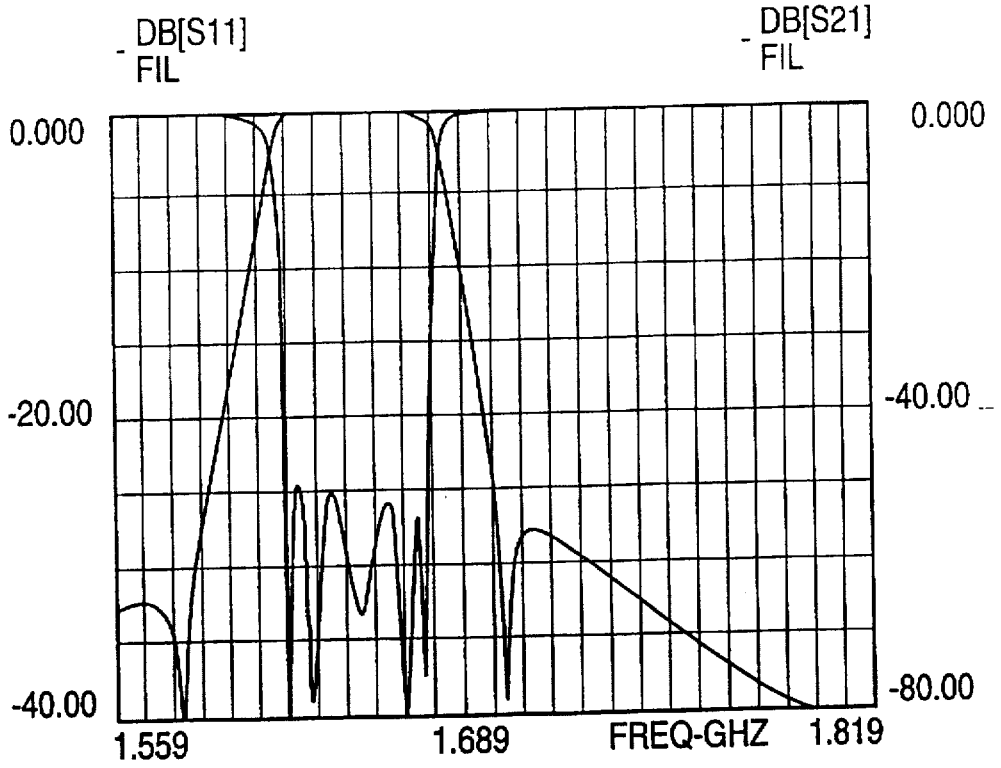
FIG. 12 shows a 1–4 cross coupling where the electrical line length is about ¼ wavelength.
Figure 13:
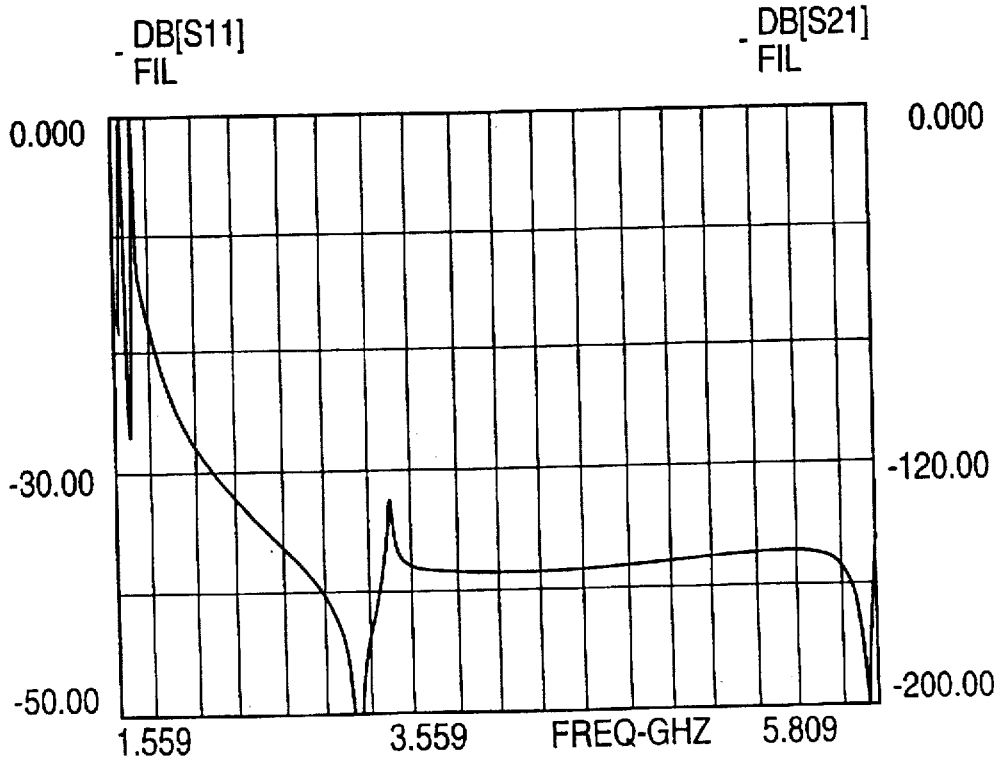
FIG. 13 shows a slight degradation of the stopband.

When the electrical length of the coax was about a quarterwave long, the cross coupling 1–4 produced a highside and lowside attenuation pole (FIG. 12). At the high end of the stopband there was a strange type of pole/zero response that was moving down in frequency from the filter halfwave frequency (FIG. 13).

Figure 14:
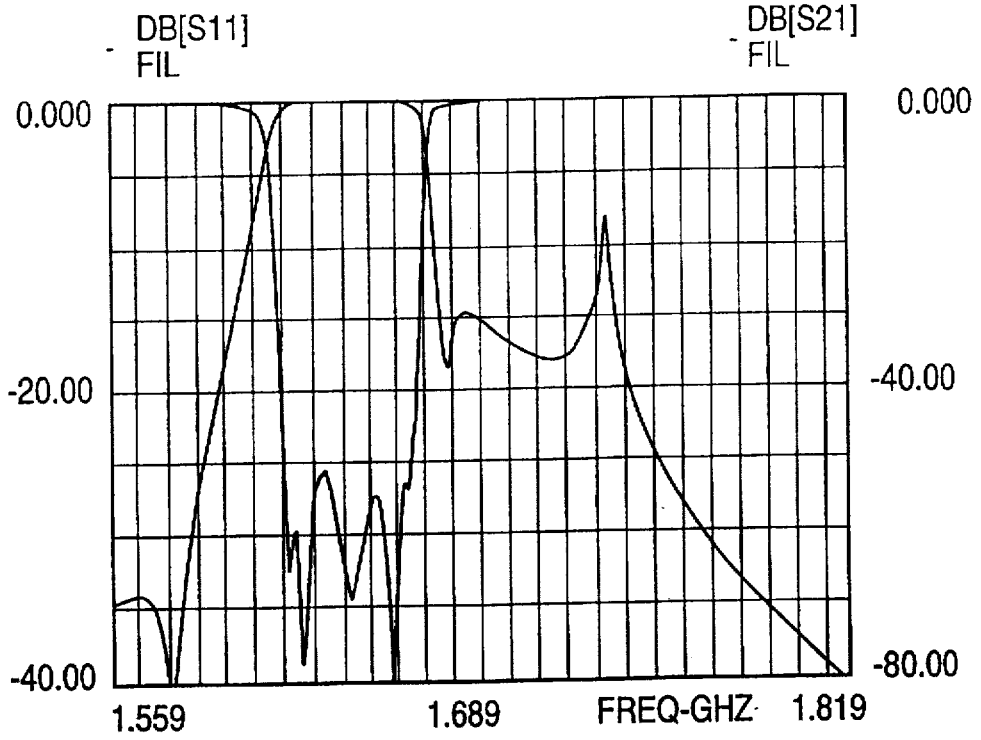
FIG. 14 shows the same filter when the cross coupling electrical line length approaches ½ wavelength.
Figure 15:
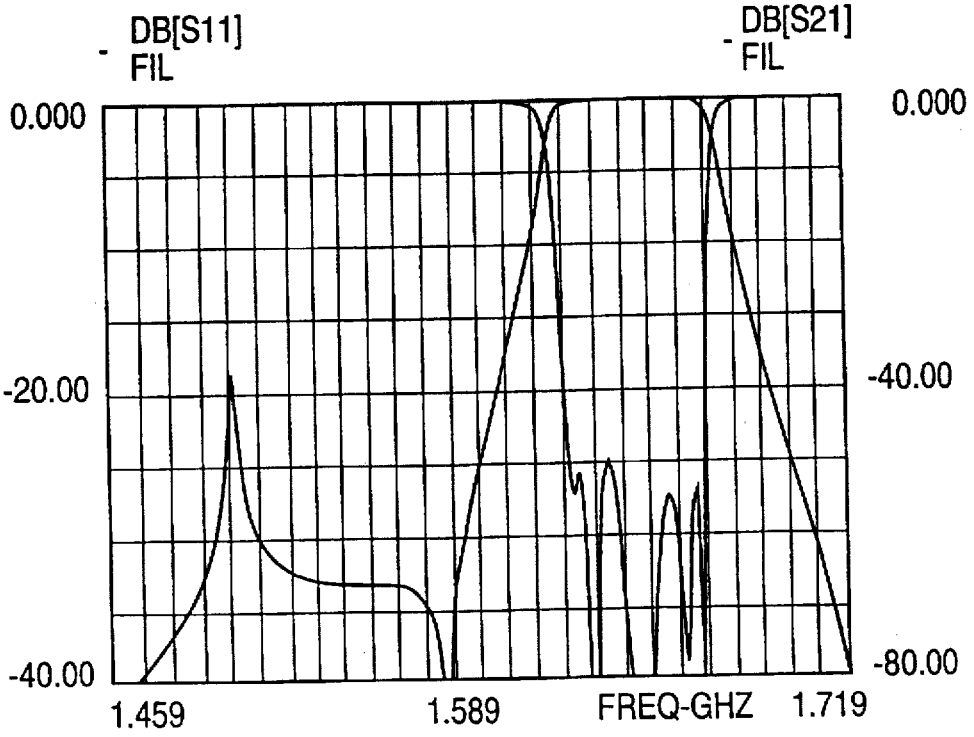
FIG. 15 is a model thereof with the line length well over ½ wavelength.

As the electrical length of the coax cable approached halfwave, the pole/zero response moved down close enough to the passband that the frequency response of the skirt was all but destroyed (FIG. 14). As coaxial electrical line lengths varied between halfwave and fullwave, the passband of the filter was no longer recognizable. However, there were line lengths in this range where there was a passband but the finite poles were not evident. The line lengths appeared overly sensitive to be any practical value. It was not until the coaxial line length approached 1.1 wavelengths that the response was again usable (FIG. 15). But, the response did not approach the original cross coupled response until the line length approached ⅝ wavelength (not shown). Note also that the pole/zero "glitch" is now on the lowside of the band. The results then seem to indicate coax electrical line lengths that are multiples of a wavelength plus one quarter wave in order for the 1–4 cross coupling to be effective.

The physical realizability is then the major concern. Suppose that the B'-dimension of the filter is one eighth wavelength (about 9 inches (2.4 cm.) for a typical transmit frequency). B' as used herein means the cavity width. For iris couple filters the spacing between resonators is about one B'-dimension. The physical length between the 1–4 resonator is therefore about ⅜ wavelength. Taking into account the dielectric in the coax, the electrical line length is a little over half wavelength and the cross coupling is doomed to failure.

It is apparent that a (n+¼)*wavelength for the cross coupling is needed. The line electrical length must be an integral number of multiple wavelengths long plus ¼ of a wavelength. For n=1 this means one needs a 'B' of about one third wavelength (more exactly 'B'=2.07 inches (5.2 cm.) for the transmit channel). This analysis does not take into account the bend length in the coax cable. The line length requirements of the 1–4 cross coupling are very stringent. In design where it seems necessary to utilize this 1–4 type of cross coupling, one must have the freedom to chose the appropriate 'B'-dimension in order to optimize this line length so that the electrical length is multiples of a wavelength plus one quarter wavelength.

Figure 8:
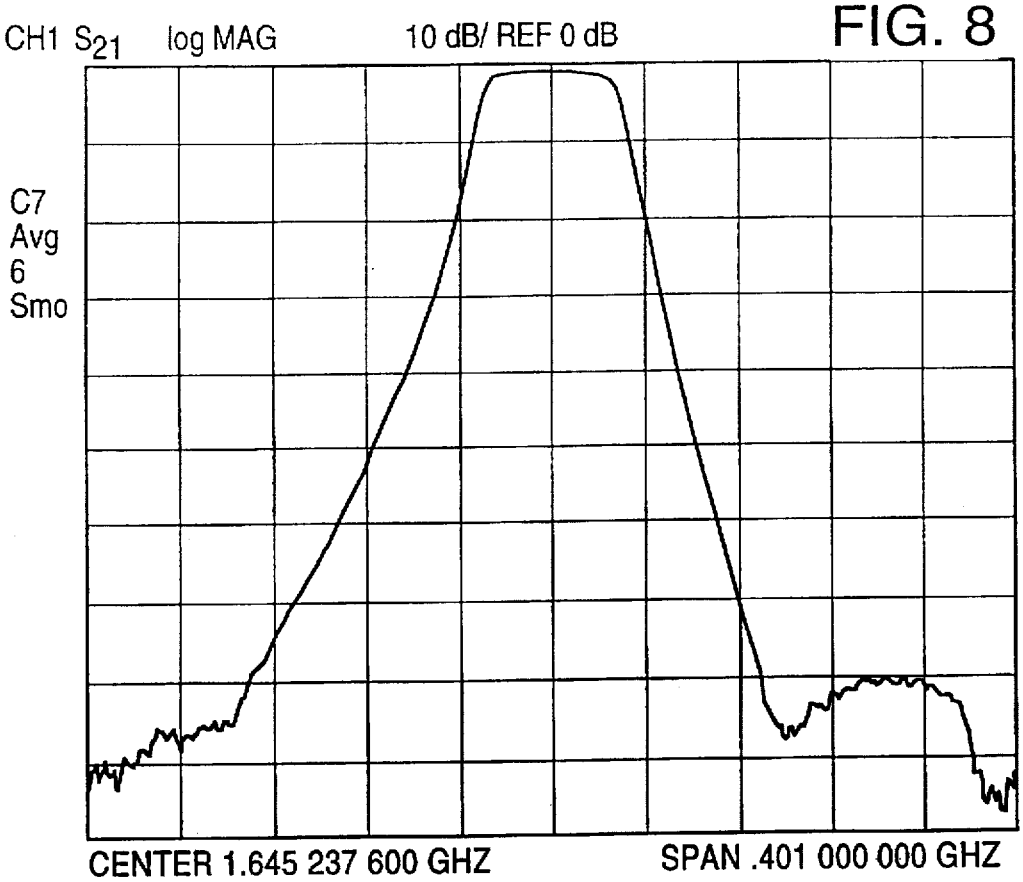
FIG. 8 illustrates a bench electrical modeling with a ¾ electrical wavelength coaxial line.
Figure 9:
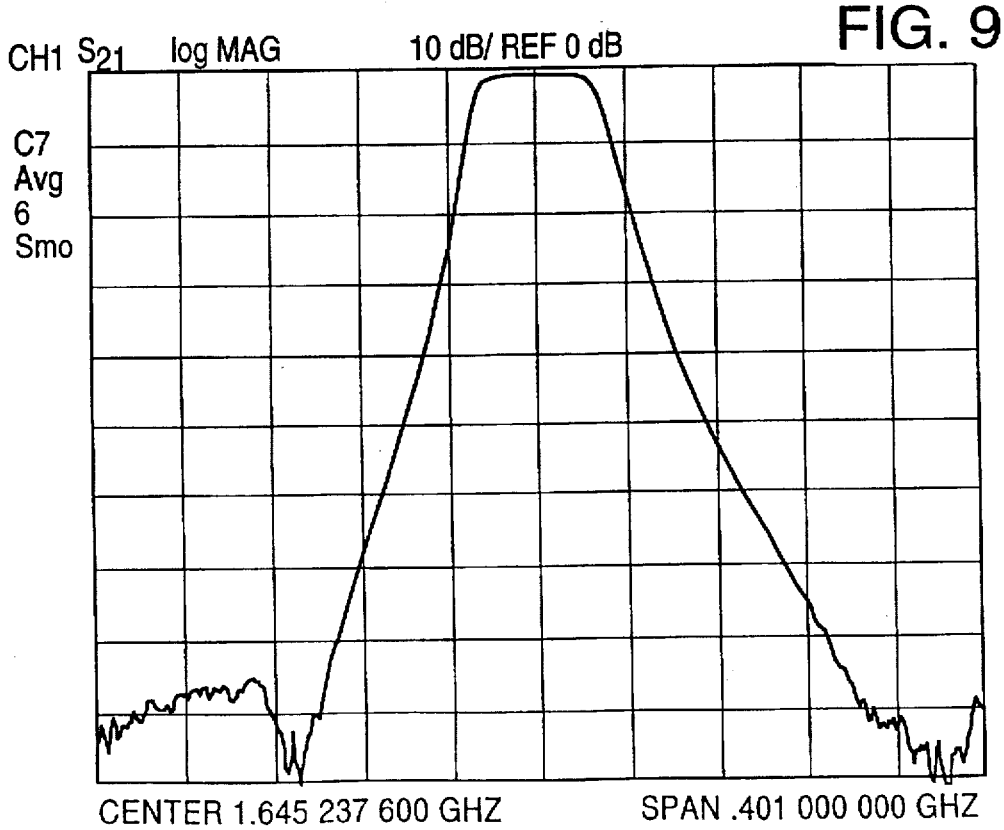
FIG. 9 illustrates a bench-electrical modeling with a ½ electrical wavelength coaxial line.

FIGS. 8 and 9 represent real data.

Figure 10:
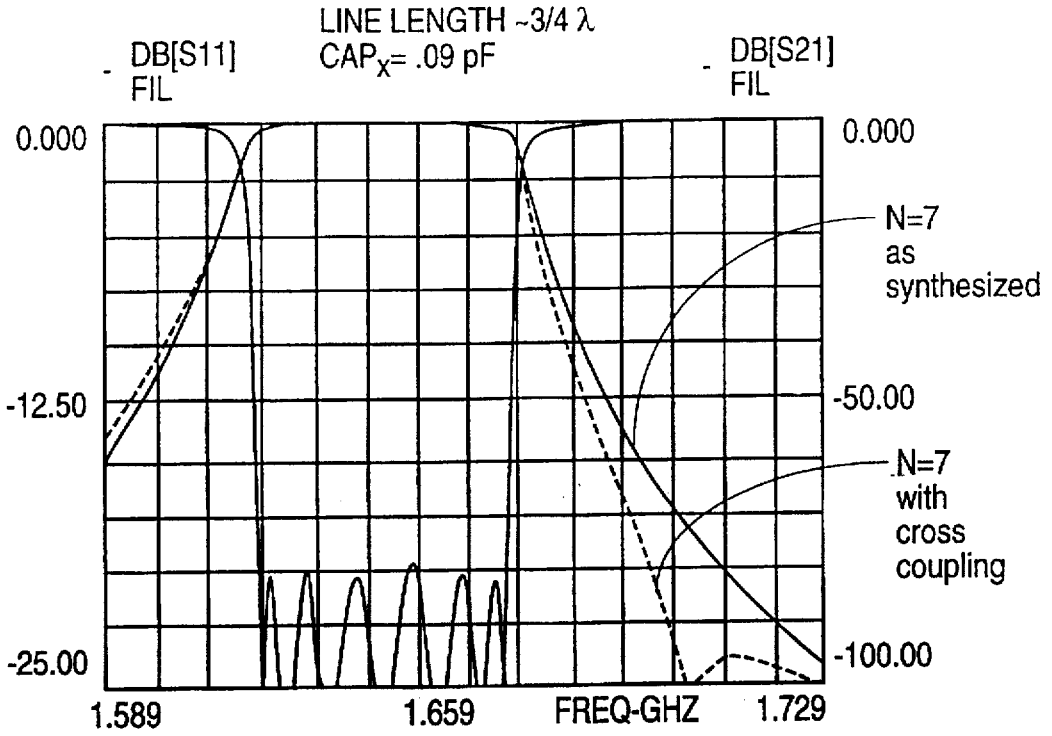
FIG. 10 is an electrical model of a seven section filter with and without cross coupling.

In FIG. 10, even though the cross coupling was modeled as capacitive because of the electrical line length the finite pole is on the highside skirt which is indicative of inductive cross coupling. This is an example of 1–3 cross coupling.

Figure 11:
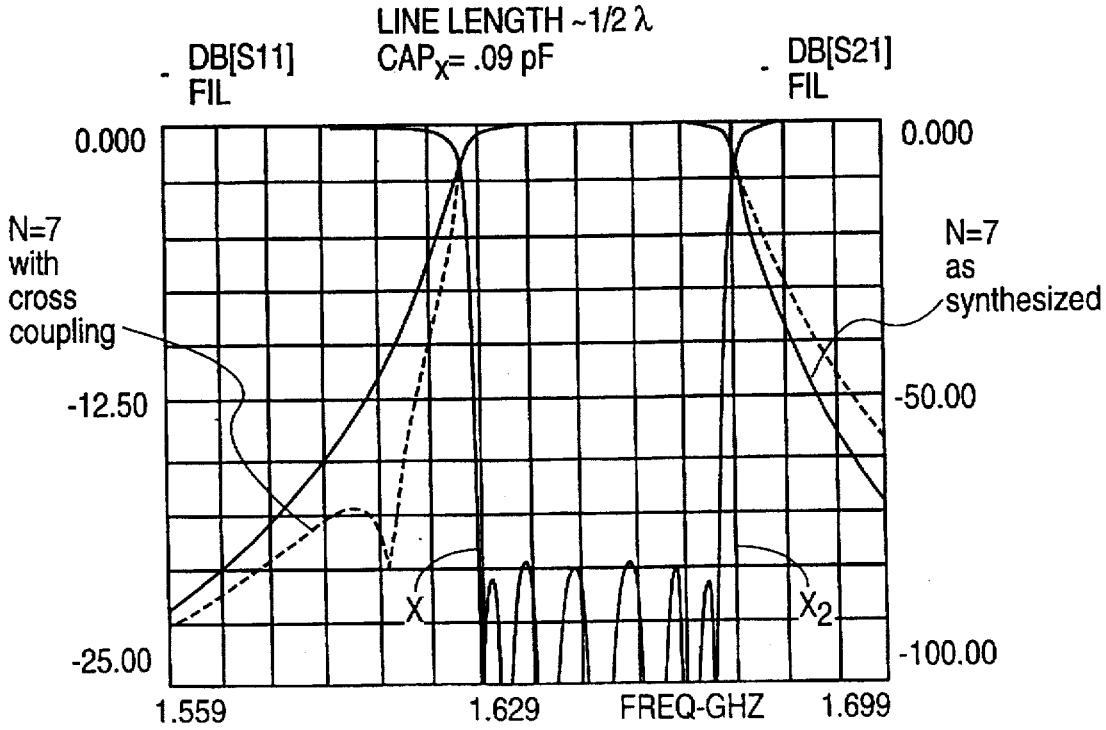
FIG. 11 is an electrical model thereof with the line length shortened.

As to FIG. 11, the cross coupling again appears as capacitive (1–3 cross coupling, finite pole on the lowside skirt).

As to FIG. 12, notice that 1–4 capacitive cross coupling yields finite poles on the low and high side skirts.

FIG. 13 shows that the skirt region is well above the passband). The glitch is a 'pole/zero' combination due to the electrical line length of the coaxial cable.

FIG. 14 shows that the longer line length has moved the 'pole/zero' glitch lower in frequency, closer to the passband. This is a poor response and the filter is all but unusable.

FIG. 15 shows that the 'pole/zero' glitch has moved below the passband. This filter is also probably not acceptable.

FIGS. 12 through 15 show the sensitivity of 1–4 cross couplings to the electrical line length of the coaxial cable. 1–4 cross coupling with coaxial cable is probably only effective if the line length is electrically very short (easy in internal cross coupling, but impossible with coaxial cable) or the electrical line length is an integral multiple of one wavelength plus ¼ wavelength. Note 1–3 cross couplings do not show this bad tendency.

Figure 16:
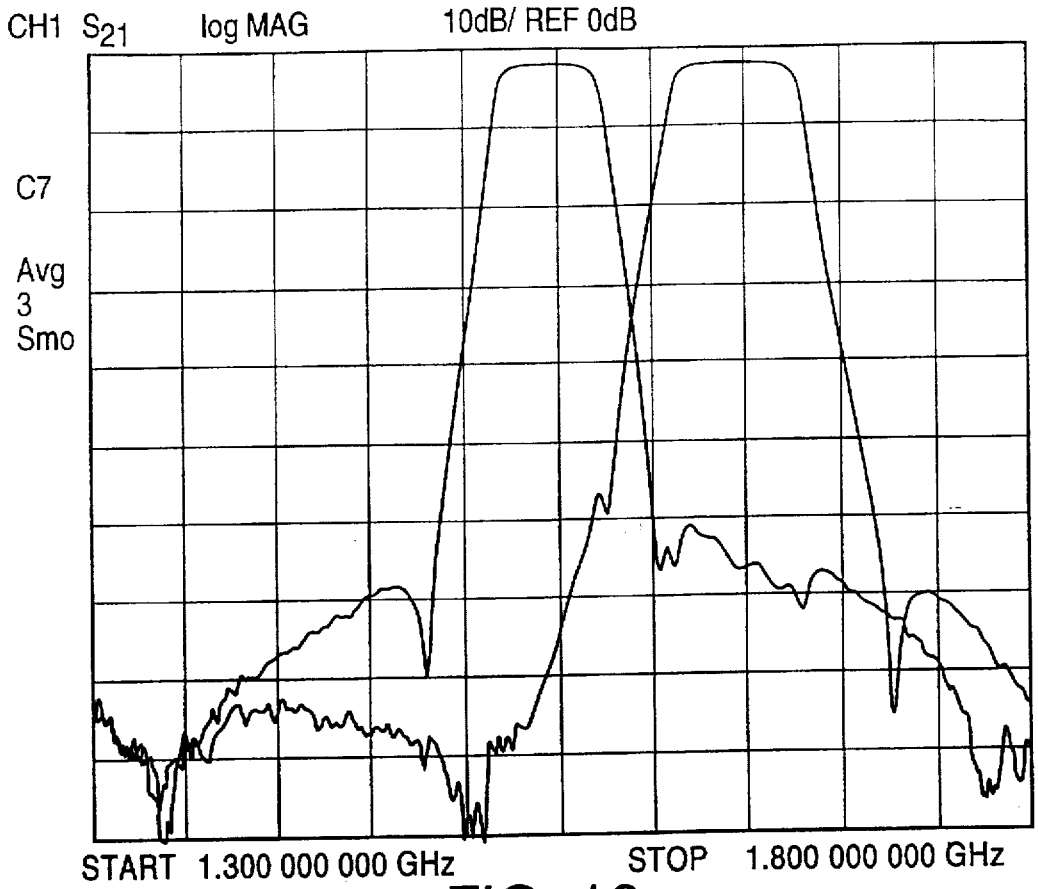
FIG. 16 is a graph of the actual measured performance of the diplexer of the invention.
Figure 17:
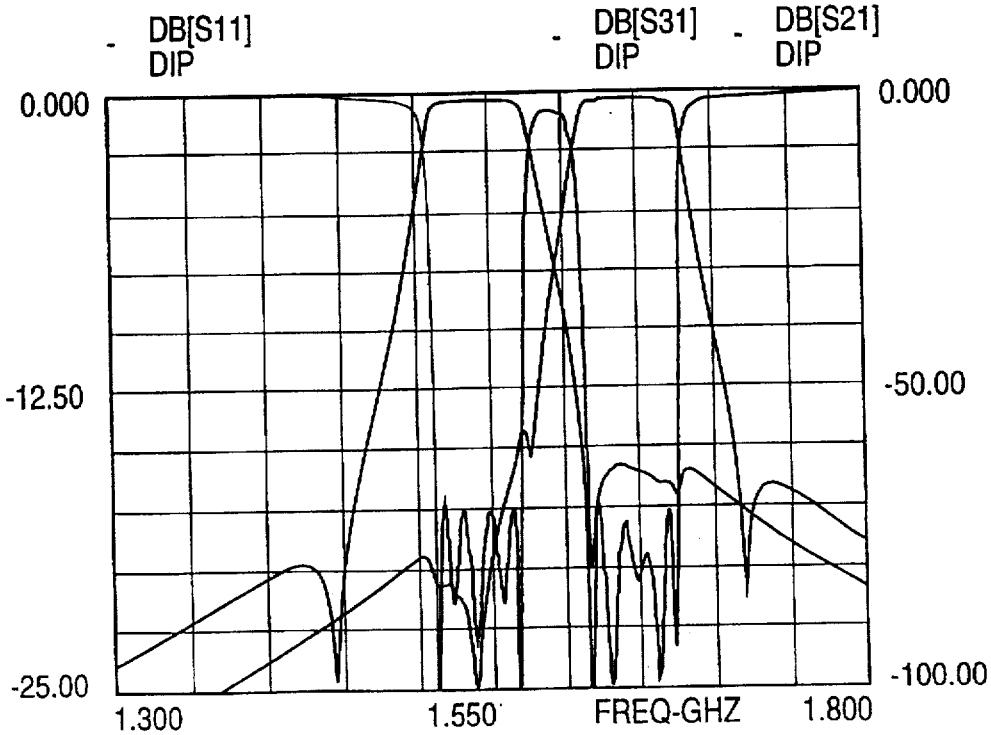
FIG. 17 is a graph of the modeled electrical performance thereof.

FIGS. 16 and 17 show the performance of the diplexer of FIGS. 2–7. FIG. 17 shows the modeled electrical performance of the diplexer. FIG. 16 shows the measured performance. The measured data was taken on an HP 8720. It is noted that the nuances of the skirt response are accurately predicted by the electrical model. The insertion loss of the diplexer is higher than that predicted by the model. This is because the actual diplexer is a developmental unit. This means there is exposed aluminum in the cavity. Aluminum has a lower conductivity than silver. This lower conductivity translates into higher insertion loss. Also, the finite poles on the skirts of the filters are not at the exact frequency they are supposed to be according to the design. This is easily corrected by adjusting the length of the coaxial cable probe.

The above description of embodiments of this invention is intended to be illustrative and not limiting. Other embodiments of this invention will be obvious to those skilled in the art in view of the above disclosure.

I claim:

1. A cross coupled bandpass filter comprising:

a filter housing having a series of spaced resonators positioned therein along at least one longitudinal axis of the filter, said resonators each including a conductive rod upstanding from a bottom wall of said housing, said housing having an upper wall including a longitudinal slot at one longitudinal edge of the upper wall; and at least one coaxial cable portion having a first connecting section extending along the upper wall of said housing displaced from the at least one longitudinal axis, said connecting section being embedded into said slot, said cable portion having integral end sections including an inner conductor of said coaxial cable portion, extending at an angle from the at least one longitudinal axis variously in a spaced-gap proximity to the conductive rods of a selected first two of said series of resonators, said first two of the resonators having at least one other resonator of said series of resonators extending therebetween such that a finite pole is realized on at least a highside skirt of the filter response.

2. The filter of claim 1 in which said housing upper wall is a housing cover, said first connecting section of the cable portion being embedded in said housing cover slot.

3. The filter of claim 2 in which said first connecting section is in a press-fitted engagement in the slot.

4. The filter of claim 2 wherein said cover extends in a plane parallely spaced from said bottom wall.

5. The filter of claim 2 wherein said cable portion extends in a bent inverted U-shaped configuration from a longitudinal underside edge of said cover with said integral end sections overlying said first two resonators and being spaced from associated ones of the conductive rods of said first two resonators.

6. The filter of claim 2 wherein said cable portion end sections include an exposed coax dielectric portion overlying associated ones of the conductive rods of said first two resonators.

7. The filter of claim 2 in which part of said first connecting section extends below an underside of said housing cover such that, upon assembly, the first connecting section is effectively grounded and clamped to the upper wall of said housing.

8. The filter of claim 1 wherein the length of said cable portion for a 1–3 cross coupling is about ¾ wavelength such that a finite pole on the highside skirt of the filter response is realized.

9. The filter of claim 1 wherein two other resonators of said series of resonators extend between said first two of the series of resonators.

10. The filter of claim 1 wherein the length of said cable portion for a 1–4 cross coupling is from about 1.1 wavelengths to about 5/4 wavelength such that finite poles on both the highside skirt and a lowside skirt of the filter response is realized.

11. The filter of claim 10 wherein the cable portion electrical line length are multiples of a wavelength plus about a quarter wave.

12. The filter of claim 1 wherein a pair of in-line filters are in multiplexer form and at least a pair of said cable portions are contained in said upper wall to cross couple at least multiple pairs of said series of resonators.

13. The filter of claim 12 wherein said upper wall is a filter housing cover.

14. The filter of claim 1 in which said angle is an angle perpendicular to the at least one longitudinal axis.

15. A cross coupled bandpass filter comprising:

a filter housing having a series of spaced resonators positioned therein along at least one longitudinal axis of the filter, said resonators each including a conductive rod upstanding from a bottom wall of said housing;

at least one coaxial cable portion having a first connecting section extending along an upper wall of said housing displaced from the at least one longitudinal axis and having integral end sections including an inner conductor of said coaxial cable portion, extending at an angle from the at least one longitudinal axis variously in a spaced-gap proximity to the conductive rods of a selected first two of said series of resonators, said first two of the resonators having at least one other resonator of said series of resonators extending therebetween such that a finite pole is realized on at least a highside skirt of the filter response; and wherein selected ones of said resonators are variously configured with a half circular and half elliptical periphery to increase coupling between resonators.

16. The filter of claim 15 wherein said housing upper wall is a vertical side wall of said housing, said side wall including a pair of through-apertures adjacent a top portion of said side wall sized to receive said cable end sections, said connecting section extending along an exterior surface of the side wall and said cable end sections extending through said through-apertures.

17. The filter of claim 15 wherein selected ones of said resonators are configured with a circular or an elliptical periphery.

18. A cross coupled bandpass filter comprising:

a filter housing having a series of spaced columnar resonators positioned therein, said resonators each including a conductive rod upstanding from a bottom wall of said housing, wherein said conductive rods at equal center distances from each other; and wherein selected ones of said resonators are variously configured with a half circular periphery on one side and a half elliptical periphery on an opposite side for increasing coupling between resonators while maintaining the equal center distances between said conductive rods.

19. The filter of claim 18 wherein other selected ones of said resonators are configured with a circular periphery and another selected one of said resonators is configured with an elliptical periphery.

* * * * *